US007244222B2

(12) United States Patent
Woody et al.

(10) Patent No.: US 7,244,222 B2
(45) Date of Patent: Jul. 17, 2007

(54) APPARATUS FOR AND METHOD OF POSITIONING A SLIDER ON MATING ZIPPER ELEMENTS

(75) Inventors: Clark Woody, Pinconning, MI (US); Jeffrey S. Hoffman, Linwood, MI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 20 days.

(21) Appl. No.: 10/794,384

(22) Filed: Mar. 5, 2004

(65) Prior Publication Data

US 2005/0197240 A1 Sep. 8, 2005

(51) Int. Cl.
*B31B 1/84* (2006.01)

(52) U.S. Cl. ..... 493/213; 493/394; 493/927

(58) Field of Classification Search ..... 493/213, 493/114, 927, 394; 29/408, 768, 458
See application file for complete search history.

(56) References Cited

U.S. PATENT DOCUMENTS

| | | | | | |
|---|---|---|---|---|---|
| 3,116,544 | A | | 1/1964 | Fisher | 29/208 |
| 3,127,670 | A | | 4/1964 | Bruning | 29/408 |
| 3,256,012 | A | | 6/1966 | Bradley | 271/74 |
| 3,426,396 | A | | 2/1969 | Laguerre | 24/201 |
| 3,607,534 | A | | 9/1971 | Gutman | 156/269 |
| 3,640,050 | A | | 2/1972 | Nystrand et al. | 53/120 |
| 3,701,191 | A | | 10/1972 | Laguerre | 29/207.5 |
| 3,701,192 | A | | 10/1972 | Laguerre | 29/207.5 |
| 3,840,050 | A | | 10/1974 | Eggenberger | 137/627.5 |
| 3,854,031 | A | * | 12/1974 | Keller | 219/244 |
| 4,262,395 | A | | 4/1981 | Kosky | 24/201 |
| 4,522,678 | A | | 6/1985 | Zieke | 156/501 |
| 4,555,282 | A | | 11/1985 | Yano | 156/66 |
| 4,581,006 | A | * | 4/1986 | Hugues et al. | 493/213 |
| 4,588,070 | A | | 5/1986 | Smith | 198/468.3 |
| 4,919,415 | A | | 4/1990 | Smith et al. | 271/284 |
| 5,067,208 | A | | 11/1991 | Herrington et al. | 24/400 |
| 5,088,971 | A | | 2/1992 | Herrington | 493/203 |
| 5,283,932 | A | | 2/1994 | Richardson et al. | 24/400 |
| 5,405,478 | A | | 4/1995 | Richardson et al. | 156/308.4 |
| 5,816,018 | A | | 10/1998 | Bois | 53/133.4 |
| 5,826,401 | A | | 10/1998 | Bois | 53/412 |
| 5,827,163 | A | | 10/1998 | Kettner | 493/211 |
| 5,833,791 | A | | 11/1998 | Bryniarski et al. | 156/244.25 |
| 5,857,310 | A | | 1/1999 | Bois | 53/373.6 |
| 5,884,452 | A | | 3/1999 | Bois | 53/412 |
| 5,927,110 | A | * | 7/1999 | Yu | 70/68 |
| 6,032,437 | A | | 3/2000 | Bois | 53/412 |
| 6,085,491 | A | | 7/2000 | Bois | 53/512 |

(Continued)

FOREIGN PATENT DOCUMENTS

| | | | |
|---|---|---|---|
| EP | 0 339 324 | 11/1989 | 33/25 |

(Continued)

*Primary Examiner*—Sameh H. Tawfik

(57) ABSTRACT

An apparatus used in the manufacture of a thermoplastic zipper having a slider mounted thereon includes a pair of clamp arms disposed on opposing sides of a path of the zipper. The clamp arms are movable in directions substantially perpendicular to the zipper path so as to clamp the thermoplastic zipper to fuse a length thereof. A pair of fingers is disposed on opposing sides of the zipper path. The fingers are movable in directions substantially perpendicular to the zipper path and in directions substantially parallel with the zipper path relative to the clamp arms. The fingers push the slider along the zipper.

13 Claims, 7 Drawing Sheets

U.S. PATENT DOCUMENTS

| | | | | |
|---|---|---|---|---|
| 6,088,887 | A | 7/2000 | Bois | 24/399 |
| 6,131,374 | A | 10/2000 | Bois | 53/451 |
| 6,161,271 | A * | 12/2000 | Schreiter | 29/408 |
| 6,199,256 | B1 * | 3/2001 | Revnew et al. | 29/408 |
| 6,213,640 | B1 | 4/2001 | Bois | 383/25 |
| 6,220,754 | B1 | 4/2001 | Stiglic et al. | 383/64 |
| 6,261,000 | B1 | 7/2001 | Bois | 383/120 |
| 6,287,001 | B1 | 9/2001 | Buchman | 383/64 |
| 6,305,844 | B1 | 10/2001 | Bois | 383/64 |
| D451,378 | S | 12/2001 | Kinigakis et al. | D9/305 |
| 6,334,709 | B1 | 1/2002 | Bois | 383/37 |
| 6,357,914 | B1 | 3/2002 | Kinigakis et al. | 383/64 |
| 6,418,605 | B1 * | 7/2002 | Kettner | 29/408 |
| 6,517,473 | B1 * | 2/2003 | Cappel | 493/213 |
| 6,526,726 | B1 * | 3/2003 | Strand et al. | 53/412 |
| 6,713,152 | B2 | 3/2004 | Chen et al. | 428/99 |
| 6,804,935 | B2 * | 10/2004 | Schneider et al. | 53/412 |
| 6,851,248 | B2 * | 2/2005 | Knight et al. | 53/133.4 |
| 2004/0050017 | A1 | 3/2004 | Thomas et al. | 53/412 |
| 2004/0055255 | A1 | 3/2004 | Knight et al. | 53/412 |
| 2004/0066985 | A1 | 4/2004 | Patel et al. | 383/64 |
| 2004/0066986 | A1 | 4/2004 | Erlick et al. | 383/64 |
| 2004/0081375 | A1 | 4/2004 | Pokusa | 383/64 |

FOREIGN PATENT DOCUMENTS

| | | | |
|---|---|---|---|
| EP | 0 371 402 | 6/1990 | 19/16 |
| EP | 0 633 187 | 1/1995 | 9/20 |
| EP | 0 667 288 | 8/1995 | 61/18 |
| EP | 0 689 993 | 1/1996 | 9/20 |
| EP | 0 691 266 | 1/1996 | 9/20 |
| EP | 0 775 633 | 5/1997 | 9/20 |
| EP | 0 792 801 | 9/1997 | 9/20 |
| EP | 0 792 802 | 9/1997 | 9/20 |
| EP | 0 855 346 | 7/1998 | 33/25 |
| EP | 0 888 973 | 1/1999 | 33/22 |
| EP | 0 906 866 | 4/1999 | 9/20 |
| EP | 0 908 392 | 4/1999 | 33/16 |
| EP | 0 910 539 | 4/1999 | 33/25 |
| EP | 0 912 327 | 5/1999 | 19/36 |
| EP | 0 915 019 | 5/1999 | 61/18 |
| EP | 0 918 688 | 6/1999 | 9/20 |
| EP | 0 925 229 | 6/1999 | 33/25 |
| EP | 0 938 427 | 9/1999 | |
| EP | 0 980 333 | 2/2000 | 33/14 |
| EP | 0 994 772 | 4/2000 | 19/90 |
| EP | 0 998 413 | 5/2000 | |
| EP | 1 000 559 | 5/2000 | 19/26 |
| EP | 1 003 395 | 5/2000 | 19/26 |
| EP | 1 013 401 | 6/2000 | 47/4 |
| EP | 1 038 774 | 9/2000 | 9/20 |
| EP | 1 091 883 | 4/2001 | 33/25 |
| EP | 1 094 932 | 5/2001 | 19/90 |
| EP | 1 106 337 | 6/2001 | 19/90 |
| EP | 1 107 863 | 6/2001 | 19/90 |
| EP | 1 140 481 | 10/2001 | 19/60 |
| EP | 1 169 934 | 1/2002 | 19/26 |
| GB | 2 120 999 | 12/1983 | 30/10 |
| WO | WO 98/02354 | 1/1998 | 9/20 |
| WO | WO 98/32593 | 7/1998 | 19/36 |
| WO | WO 98/45182 | 10/1998 | 33/25 |
| WO | WO 98/50277 | 11/1998 | 33/14 |
| WO | WO 98/57863 | 12/1998 | 33/25 |
| WO | WO 99/24322 | 5/1999 | |
| WO | WO 99/36325 | 7/1999 | 33/25 |
| WO | WO 99/56947 | 11/1999 | 19/90 |
| WO | WO 99/62780 | 12/1999 | |
| WO | WO 99/65353 | 12/1999 | 19/16 |
| WO | WO 00/02722 | 1/2000 | 19/90 |
| WO | WO 00/37246 | 6/2000 | 19/90 |
| WO | WO 00/64765 | 11/2000 | 33/25 |
| WO | WO 01/02162 | 11/2001 | 19/90 |

* cited by examiner

APPARATUS FOR AND METHOD OF POSITIONING A SLIDER ON MATING ZIPPER ELEMENTS

BACKGROUND

1. Technical Field

This invention relates generally to an apparatus for and method of moving a slider mounted on mating zipper elements during the production of plastic bags or the like, and in particular to an apparatus for and method of fusing a length of the mating zipper elements and positioning the slider with respect to the fused length.

2. Background Art

The manufacture of thermoplastic bags and the like containing mating zipper elements (i.e., a thermoplastic zipper typically having a rib and groove construction) that are operated by a slider mounted thereon are known in the art. There are a wide variety of designs for such devices. For example, U.S. Pat. Nos. 5,067,208; 4,262,395; and 5,283,932, show different types of sliders and mating zipper elements used in the construction of re-sealable thermoplastic bags. In these and other known arrangements, the sliders operate to connect and disconnect (depending on the direction of movement) opposing mating zipper elements (i.e., an opposing rib and groove) as the slider is moved along the length of the zipper by a user. Thus, by moving the slider, the user can open or close the re-sealable thermoplastic bag or other such product.

In the manufacture of such thermoplastic bags, for example, a web of folded thermoplastic film is used to form a series of bags. Formed on ends of the folded thermoplastic film opposite the fold are corresponding mating zipper elements. As the film is fed along different stages of the manufacturing process, various assemblies perform tasks such as mounting the sliders on the zippers corresponding to separate bags, severing and sealing the film in directions perpendicular to the fold to form the lateral edges of the separate bags, and fusing specified lengths of the mating zipper elements to form the ends thereof for separate bags.

In a typical manufacturing process, the thermoplastic film is indexed to a registered position (i.e., one stage of manufacturing) at which movement of the film is halted while individual components perform different manufacturing processes, such as those described above. At some stages, it may be necessary to move the slider along the mating zipper elements so that it does not interfere with certain processes, or so that the slider is properly positioned for packaging and shipping.

For instance, one stage of the manufacturing process will typically include clamp/stomp members that clamp/stomp a length of the mating zipper elements to meld or crush the elements together to define the ends of the zippers of different bags. Typically, such stomp members are heated so as to fuse the mating zipper elements. It is preferable to move the slider along the zipper after fusion so as to move the slider to a predetermine position along the mating zipper elements.

In one known system for positioning the sliders as described above, the thermoplastic film is indexed to a registered position at which heated stomp members fuse a length of the mating zipper elements. As the fused length is then indexed to the next stage in the manufacturing process, a projection is brought into range of the thermoplastic film such that the projection does not interfere with the movement of the film, but prevents a corresponding slider from moving in the path of the film. This causes the slider to remain still as the film is indexed. The movement of the slider along the mating zipper elements connects/closes the mating zipper elements. Once the film has moved with respect to the slider and projection such that the slider comes into contact with a corresponding fused length of the mating zipper elements, the projection is brought out of contact with the slider. Consequently, the slider is positioned at a predetermined position along the mating zipper elements relative to the fused length of the zipper elements, and resumes movement in the film path.

Of course, this projection arrangement can be used in conjunction with other stages of manufacturing to position the slider for other reasons. For instance, the slider may be moved so as to not interfere with other components of the manufacturing process that act on the film.

However, use of the movable projection discussed above has several drawbacks. In particular, because the projection is operated separately from the apparatus for fusing the mating zipper elements (or other component of the manufacturing process) the timing between the two systems can become out of sync. This in turn leads to incorrect positioning of the slider.

In addition, when the indexing speed of the film is increased, the reliability of the movable projection for precisely positioning the slider degrades. Specifically, at increased manufacturing speeds, the positioning of the projection must take place within a smaller window of time because the point along the mating zipper elements to which the slider must be moved approaches more quickly. Accordingly, small timing errors are magnified at faster operating speeds.

Such inaccuracies can lead to the projection not releasing from the slider in time, causing the slider to move past the intended position or, when the slider is to abut a fused length of the zipper, to catch on the fused portion and build up tension in the moving film. Also, when the slider is being moved to close the mating zipper elements, if the projection releases its contact with the slider too soon or fails to catch the slider at all, the slider may not be moved to the predetermined position relative to the fused length of the zipper.

These problems become even more apparent in modern manufacturing processes in which the film is not indexed between stages, but instead is continually fed through the manufacturing system. In such systems, the film is continually moved along the manufacturing path as movable apparatuses for performing certain manufacturing steps are moved therewith at the same rate. The different apparatuses are typically moved along a rotating path so that they come into contact with the film at given intervals.

For instance, the stomp members may be provided on a rotating belt such that the stomp members move along the film path for a set interval at the same rate of speed as the film (see FIG. 6 and the accompanying text below). Accordingly, the stomp members may stomp and fuse the mating zipper elements as the film and stomp members move together along the film path. Such a manufacturing process allows for much faster run times.

Therefore, not only is there a need for a mechanism to accurately position the sliders in assembly lines running at higher rates of speed, but there is also a need for positioning mechanisms that can operate in continuous movement systems, in conjunction with movable assembly stages such as the moving stomp members discussed above.

SUMMARY OF THE INVENTION

This invention addresses the foregoing needs by providing an apparatus for and method of more accurately moving sliders along mating zipper elements during the manufacture of products including mating zippers elements operated by such sliders.

In addition, the present invention addresses the foregoing needs by providing an apparatus for and method of moving sliders along mating zipper elements relative to fused/stomped lengths of mating zipper elements during the manufacture of products including the same. Also, the present invention addresses the foregoing needs by providing an apparatus for and method of moving sliders along mating zipper elements in conjunction with and/or relative to stomp members (clamp arms) for fusing/stomping the lengths of mating zipper elements.

In a first aspect of the invention, an apparatus used in the manufacture of a thermoplastic zipper having a slider mounted thereon includes a pair of clamp arms disposed on opposing sides of a path of the zipper. The clamp arms are movable in directions substantially perpendicular to the zipper path so as to clamp the thermoplastic zipper to fuse a length thereof. The apparatus also includes a pair of fingers disposed on opposing sides of the zipper path. The fingers are movable in directions substantially perpendicular to the zipper path and in directions substantially parallel with the zipper path relative to the clamp arms. The fingers push the slider along the zipper.

In a second aspect of the invention, a manufacturing apparatus for positioning a slider mounted on a thermoplastic zipper includes a pair of fingers disposed on opposing sides of a path of the zipper. The fingers are movable in directions substantially perpendicular to the zipper path and in directions substantially parallel with the zipper path. The fingers move in a direction perpendicular to the zipper path so as to be positioned at a distance from the zipper at which the slider cannot pass between the fingers along the zipper. The fingers move in a direction parallel with the zipper path and relative to the apparatus to push the slider along the zipper to a registered position.

In a third aspect of the invention, a method of manufacturing a thermoplastic zipper having a slider mounted thereon includes the steps of feeding the zipper along a zipper path, and moving clamp arms disposed on opposing sides of the zipper path in directions substantially perpendicular to the zipper path to clamp and fuse a length of zipper. The method also includes the steps of releasing the zipper from the clamp arms and moving a pair of fingers disposed on opposing sides of the zipper path in directions substantially perpendicular to the zipper path and in directions substantially parallel with the zipper path relative to the clamp arms. The slider is pushed by the movement of the fingers.

In a fourth aspect of the invention, a method of positioning a slider mounted on a thermoplastic zipper during manufacture of a product containing the same includes a step of indexing the zipper along a zipper path. The method also includes a first moving step of moving a pair of fingers disposed on opposing sides of the zipper path in directions substantially perpendicular to the zipper path so as to be positioned at a distance from the zipper at which the zipper can pass and the slider cannot pass between the fingers. In addition, the method includes a second moving step of moving the fingers relative to the zipper in directions substantially parallel with the zipper path to push the slider along the zipper to a registered position.

In another aspect of the present invention, an apparatus for positioning a slider mounted on a thermoplastic zipper in the manufacture of a product containing the slider and thermoplastic zipper includes fusing means for fusing a length of the zipper. The apparatus further includes moving means for moving members positioned on opposing sides of a path of the zipper in a direction toward and perpendicular to the zipper path to a distance from the zipper at which the slider cannot pass therebetween. Still further, the apparatus includes biasing means for biasing the members in a direction substantially parallel with the zipper path and relative to the fusing means so as to push the slider along the zipper to a predetermined position relative to the fused length of the zipper elements.

Other aspects and advantages of the present invention will become apparent upon consideration of the following detailed description.

DESCRIPTION OF THE PREFERRED EMBODIMENT(S)

It is preferred that the slider positioning apparatus of the present invention is used in conjunction with and respect to a pressing/stomping apparatus for pressing/fusing thermoplastic mating zipper elements on a web of thermoplastic film in the manufacture of plastic bags or the like. Such a use is described below for illustrative purposes. However, the positioning apparatus of the present invention can be used for positioning sliders or the like in connection with other stages of the manufacturing processes for making products including such slider-zipper combinations.

Figure 1:
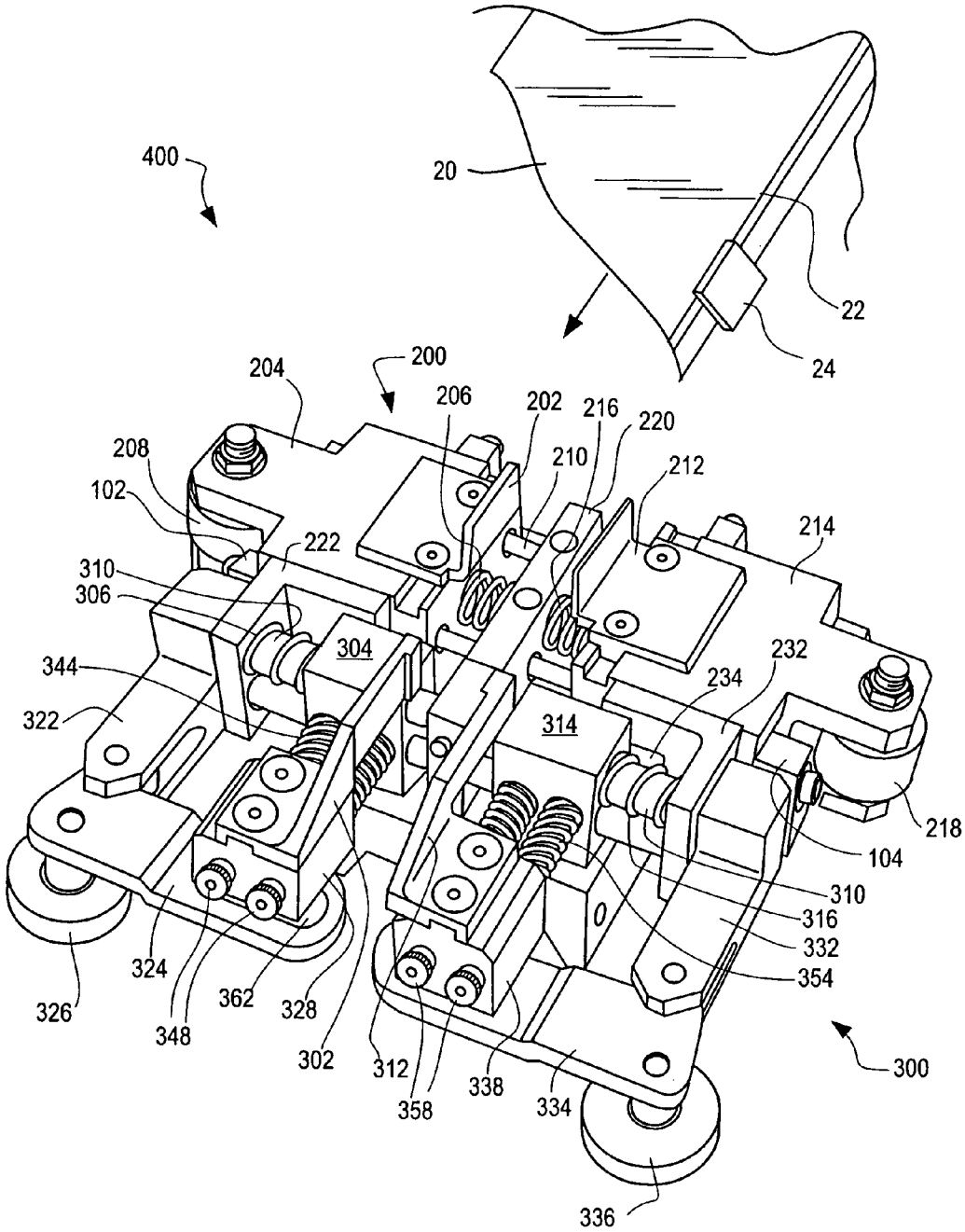
FIG. 1 is a perspective view of a pressing/docking assembly according to an embodiment of the present invention.
Figure 2:
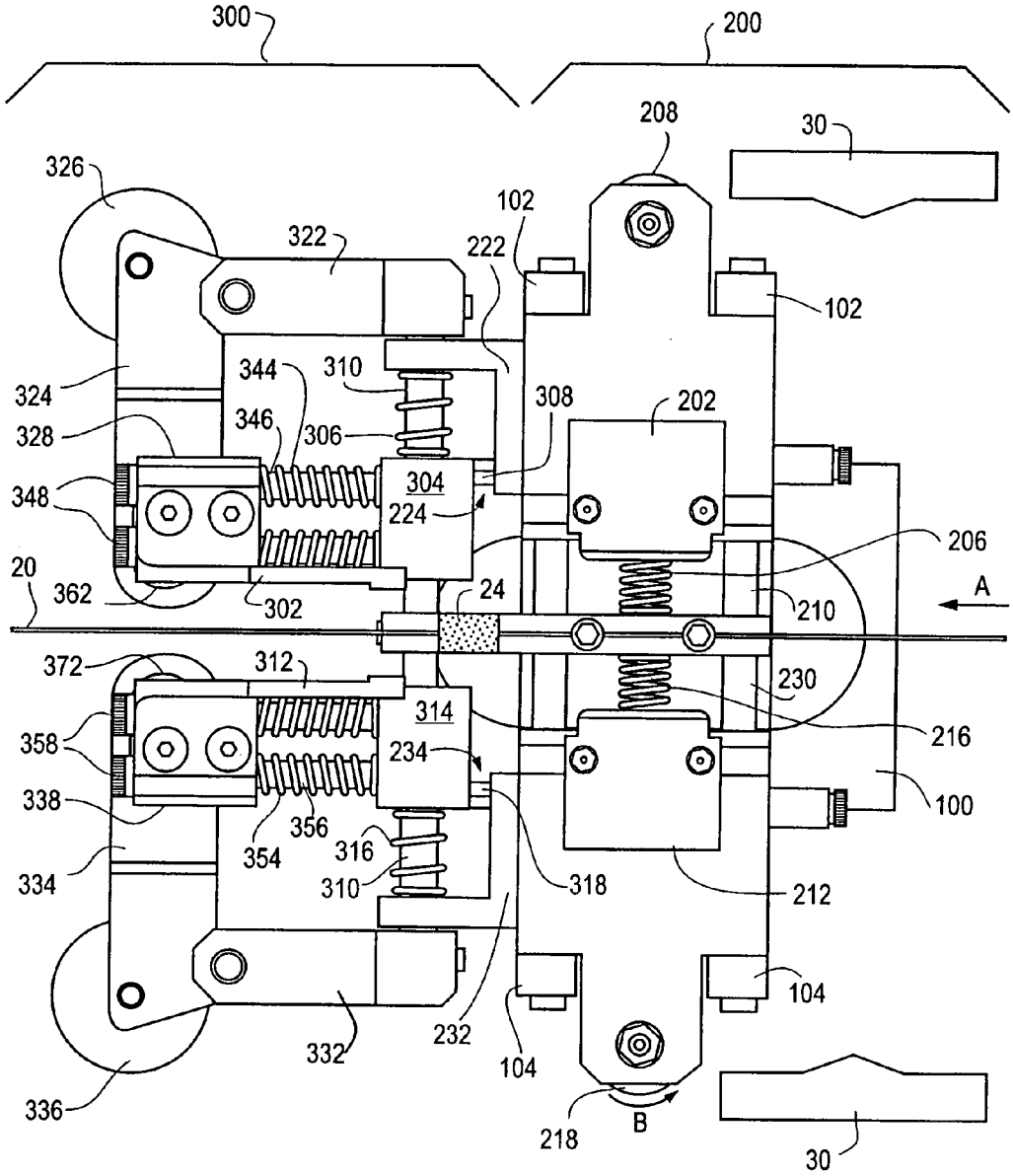
FIG. 2 is a plan view of the assembly shown in FIG. 1 in a first position of operation.

Referring to FIGS. 1 and 2, an embodiment of the present invention is shown by slider docker assembly 300 for moving a slider 24 along mating zipper elements 22. Another embodiment of the assembly of the present invention is the use of the slider docker assembly 300 in connection with press tool 200 for fusing a length of the mating zipper elements 22. The whole apparatus is shown in FIG. 1 by pressing/docking assembly 400.

The pressing/docking assembly 400 shown in FIG. 1 is preferably used in a bag-making apparatus for making re-sealable plastic bags from a web of thermoplastic film 20. The finished bags are sealable by the interaction of opposing mating zipper elements 22, which are controlled by the slider 24 mounted thereon. The thermoplastic film 22 is processed by various assemblies as it is fed along the manufacturing line until the film 20 is ultimately cut into separate sections, each of which constitutes a finished plastic bag. Of course, such zipper-slider combinations may be used in products other than bags, and the present invention may be adapted for use in the manufacture of other such products.

The pressing/docking assembly 400 shown in FIG. 1 is arranged at a position along a film-feeding lane at which the film 20 has been folded, mating zipper elements 22 have been formed along free ends of the film 20 opposite to the fold, and sliders 24 have been attached to the mating zipper elements 22, by other assemblies along the manufacturing line. The depicted press tools 202, 212 fuse lengths of the mating zipper elements 22, which fused portions ultimately define the ends of zippers of separate plastic bags or the like.

The slider docker assembly 300 moves each slider 24 to a fully closed position, with respect to a completed bag, after the fusion of the mating zipper elements 22. Later in the manufacturing process, the film will be cut and fused laterally to define the individual bags. Of course, the docker assembly 300 may be used in conjunction with other manufacturing stages in which the slider 24 must be moved along the mating zipper elements 22. In such cases, the slider 24 may be biased to a registered position as necessary for that stage of manufacturing. However, in a preferred embodiment described herein, the present invention is operated in conjunction with the press tool 200.

Figure 6:
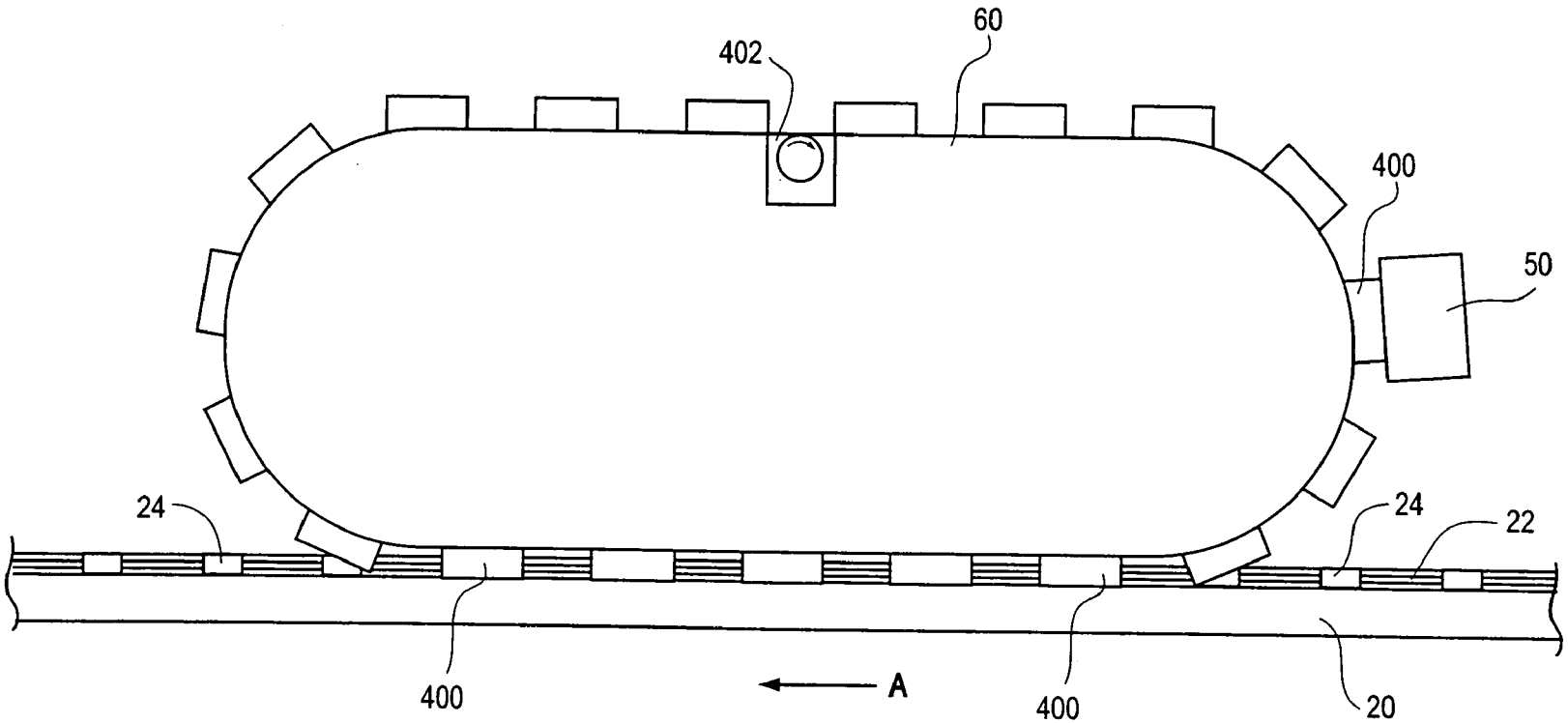
FIG. 6 is a schematic diagram of a plurality of the assemblies shown in FIG. 1 mounted on a rotating belt.

Preferably, a plurality of the pressing/docking assemblies 400 are provided in a single manufacturing lane. For instance, as shown in FIG. 6, a plurality of the pressing/docking assemblies 400 can act on a single web of thermoplastic film 20 as the film 20 is fed through the manufacturing system. Thus, separate assemblies would fuse the mating zipper elements 22 and move a slider 24 into position (i.e., move the slider 24 to a predetermined position along the mating zipper elements 22 relative to the fused portions of the zipper elements) at different positions along the film at substantially the same time.

As shown in FIG. 6, the pressing/docking assemblies 400 may be provided on a rotating belt 60 operated by a motor 402 that moves the pressing/docking assemblies 400 (in a direction indicated by arrow A) at the same speed as the film 20 travels along the manufacturing lane (which also moves in a direction indicated by arrow A). Accordingly, in the depicted embodiment, only a share of the pressing/docking assemblies 400 acts on the film 20 at any one moment.

In such an arrangement, each pressing/docking assembly 400 fuses the mating zipper elements 22 and moves the slider 24 to a predetermined position along the mating zipper elements 22 relative to the fused portions of the zipper elements, of a corresponding length of the film 20, while the pressing/docking assembly 400 and film 20 travel in the direction of arrow A.

The pressing/docking assemblies 400 are arranged on the outside of the rotating belt 60 at a distance from each other corresponding to the width of a finished bag. Typically, the belt 60 mounting the pressing/docking assemblies 400 follows a path oriented in a horizontal plane (i.e., parallel with the ground) so as to come into position to act on the film 20 which is oriented in a plane substantially parallel with the plane of the belt path. Of course, this arrangement may be varied depending on the design and requirements of the manufacturing line in which the present invention is to be used.

Figure 3:
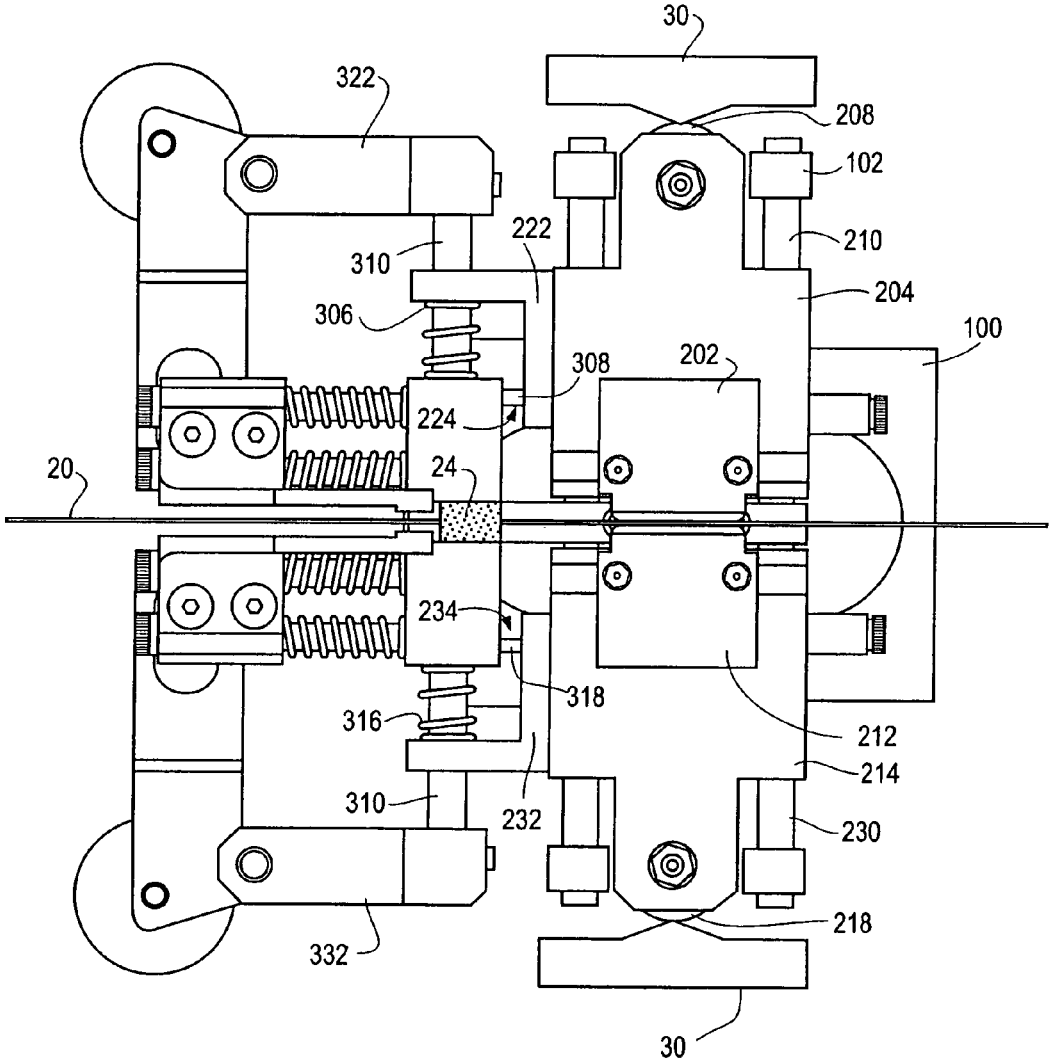
FIG. 3 is a plan view of the assembly shown in FIG. 1 in a second position of operation.
Figure 5:
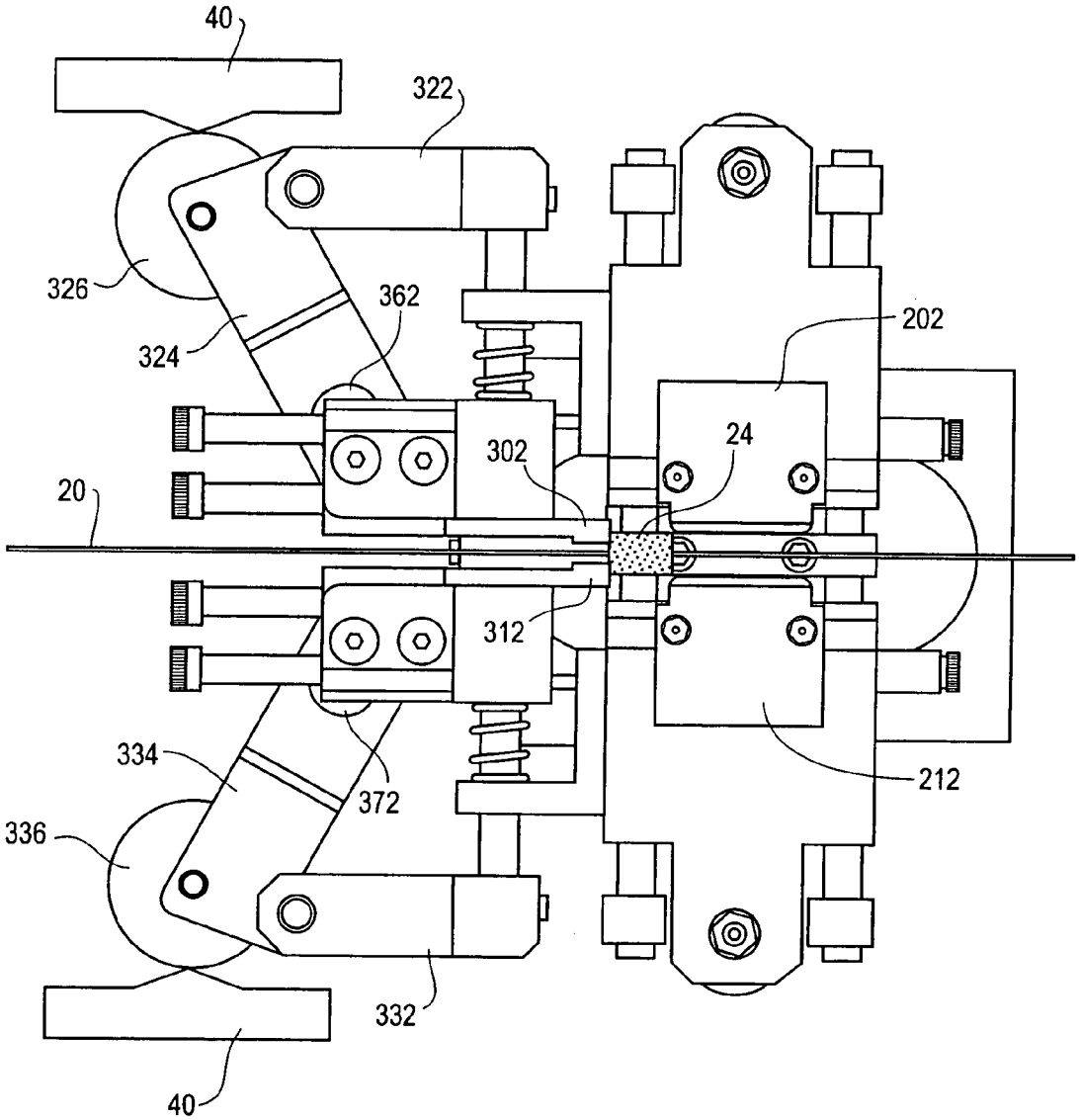
FIG. 5 is a plan view of the assembly shown in FIG. 1 in a fourth position of operation.

As shown in FIGS. 3 and 5, stationary press cams 30 and stationary docker cams 40 may be provided in conjunction with the belt 60 to operate the pressing/docking assemblies 400. Stationary press cams 30 actuate cam followers in each of the press tools 200 to control the mechanisms for fusing the mating zipper elements, as will be described in detail below. Similarly, stationary docking cams 40 actuate cam followers in each of the docking assemblies 300 to control the mechanisms for moving the sliders 24 along the mating zipper elements 22, as will also be described in detail below.

Of course, other known mechanisms may be used to control the operation of the pressing/docking assembly 400. In particular, when the pressing/docking assembly is not set in motion during the manufacturing process, stationary cams will not be effective in actuating the mechanisms of the pressing/docking assembly 400. In such cases, other arrangements may be used to control and/or power the movement of the present invention, for instance, movable cams operated by motors. However, in a preferred embodiment, the mechanisms of the pressing/docking assembly 400 are actuated as the assembly is contacted with and moved along stationary cams, as will be described below.

Specifically, as shown in FIG. 1, the pressing/docking assembly 400 includes a press tool 200. The press tool 200 includes an upper press member 202 and a lower press member 212 spaced apart from each other and including opposing flanged faces. Preferably, the opposing faces are substantially parallel with each other and the film 20. When moved into position by the rotating belt 60 (FIG. 6), the upper press member 202 is positioned above the mating zipper elements 22, and the lower press member 212 is positioned below the mating zipper elements 22.

With respect to FIG. 6, prior to being brought into position with respect to the mating zipper elements 22, as described above, press members 202, 212 of the pressing/docking assembly 400 are passed through or near an induction heater 50 as the pressing/docking assembly 400 is moved along the belt 60. Alternatively, any other means to heat the press members 202, 212 known in the art may be employed. Preferably, the press members 202, 212 are made of a material that holds heat and is conductive (e.g., steel, stainless steel, aluminum). Accordingly, the press members 202, 212 are hot when they are brought into proximity of mating zipper elements 22. As shown in FIG. 3, when the press tool 200 is put into use, the press members 202, 212 clamp a length of the mating zipper elements 22 therebetween (as the pressing/docking assemblies 400 and film 20 move in the direction of arrow A shown in FIG. 6). The pressure of the clamping action of the press members 202, 212 fuses the mating zipper elements together for a length corresponding to the length of the press members 202, 212. Faces of the press members 202, 212 may be provided with reliefs for imparting a form to the fused portions so as to crimp the mating zipper elements 22.

The press members 202, 212 preferably are heated to a temperature that will melt the mating zipper elements 22 to facilitate the fusion (i.e., crushing), but not to a temperature hot enough to burn the film 20 or mating zipper elements 22. The amount of time the press members 202, 212 are heated and clamped on the mating zipper elements 22, and the speed at which the rotating belt 60 is operated may be varied as necessary to best work with the given manufacturing line in which the any of the embodiments of the present invention are implemented.

The specific mechanical operation of the press tool 200 that causes the clamping of the mating zipper elements 22 will be described below. Of course, the specific design of the press tool 200 shown in the accompanying drawings is merely part of one embodiment of the invention. The actual mechanical interactions and control of the press members 202, 212 may be varied while keeping within the scope of the present invention.

As shown in FIG. 1, the press members 202, 212 are mounted on press member mounting blocks 204, 214, respectively. Block biasing springs 206, 216 bias the press member mounting blocks 204, 214 away from each other, and consequently, away from the film 20 positioned therebetween. The press member mounting blocks 204, 214 are mounted on block shafts 210, 230 (block shaft 230 is only seen in FIG. 2) which limit the movement of the press member mounting blocks 204, 214 to directions perpendicular to the direction shown by arrow A in FIG. 2.

The block shafts 210, 230 are mounted on an assembly bracket 100, which secures the pressing/docking assembly 400 to the rotating belt 60. Specifically, the block shafts 210, 230 are mounted on sets of movement restriction projections 102, 104 of the assembly bracket 100. The movement restriction projections 102, 104 limit the movement of press member mounting blocks 204, 214 along block shafts 210, 230 away from the film 20.

As shown in FIGS. 1 and 2, a wall 220 is provided between the press member mounting blocks 204, 214, and is mounted on assembly bracket 100. The wall 220 limits the movement of the press member mounting blocks 204, 214 toward the film 20 as they are biased by block springs 206, 216. The block springs 206, 216 are positioned between the wall 220 and the press member mounting blocks 204, 214, respectively.

Also mounted on the press member mounting blocks 204, 214 are block rollers 208, 218. The block roller 208, 218 are mounted on a shaft (not shown) such that they rotate about an axis substantially perpendicular to the block shafts 210, 230. More specifically, block roller 218 rotates in the direction indicated by arrow B in FIG. 2.

The block rollers 208, 218 serve as cam followers for the press tool 200. The block rollers 208, 218 come into contact with, and roll along, the press cams 30, shown in FIG. 3. Accordingly, as the pressing/docking assembly 400 moves on the rotating belt 60 along the film path, the block rollers 208, 218 come into contact with the press cams 30. As the block rollers 208, 218 roll along the press cams 30, the profiles of the press cams 30 actuate the block rollers 208, 218, and thus move the press member mounting blocks 204, 214 along the block shafts 210, 230. The profile of the press cams 30 may be designed so as to position properly the press member mounting blocks 204, 214 to cause the clamping of mating zipper elements 22 by the press members 202, 212 for the necessary time period (taking into account factors such as the speed of rotation of the belt 60 and the temperature of the press members 202, 212).

The press cams 30 also effect the movement of structures in the docker assembly 300. L-shaped brackets 222, 232, as seen in FIGS. 2 and 3, are secured to the press member mounting blocks 204, 214 and transfer the actuating force from the press member mounting blocks 204, 214 to structures in the slider docker assembly 300. In particular, the L-shaped brackets 222, 232 transfer a biasing force to docker blocks 304, 314.

The slider docker assembly 300 operates to move fingers 302, 312 so as to come into contact with the slider 24 and move it into position along the mating zipper elements 22, preferably with respect to the zipper length fused by the press members 202, 212. In the embodiment shown in the drawings, the fingers 302, 312 push the slider 24 along the mating zipper elements 22 in a direction opposite to the direction of movement of the film 20 after the press members 202, 212 fuse a portion of the mating zipper elements 22. The specific mechanics of the slider docker assembly 30 will be described below. However, the depicted embodiment is just one arrangement for operating the fingers 302, 312. Other arrangements are available while keeping within the scope of the present invention.

In preferred embodiments, the fingers 302, 312 are moved in one direction to come into contact with the slider 24, and then in a second direction to move the slider 24 with respect to the film 20. In the depicted embodiment, L-shaped brackets 222, 232 transfer actuating force to move the fingers 302, 312 to come into contact with the slider 24 (i.e., in a direction perpendicular to the film path).

Specifically, L-shaped brackets 222, 232 (which are secured to press-member mounting blocks 204, 214) are slidably mounted on docker shafts 310 such that the shafts 310 project through one flange of the L-shaped brackets 222, 232, respectively. The docker shafts 310 also project through the wall 220 in which they are engaged by screws or other securing means (not shown) to secure the docker shafts 310 with respect to the wall 220.

Slidably mounted on the docker shafts 310 between the wall 220 and the L-shaped brackets 222, 232, respectively, are docker blocks 304, 314 and block springs 306, 316 (mounted on one of the docker shafts 310 in the depicted embodiment). The block springs 306, 316 are positioned between the L-shaped brackets 222, 232 so as to provide a biasing force to bias the docker blocks 304, 314 from the L-shaped brackets 222, 232 toward wall 220.

As shown in FIG. 2, posts 308, 318 extend from the docker blocks 304, 314 so that free ends thereof are positioned in slots 224, 234 of the L-shaped brackets 222, 232 (one of which is shown in FIG. 1), respectively. The slots 224, 234 are arranged to extend in directions parallel with the direction of the biasing force from the block springs 306, 316. Due to the force from block springs 306, 316, the free ends of the posts 308, 318 abut ends of the slots 224, 234 closest to the wall 220, which limits the movement of the docker blocks 304, 314 along the docker shafts 310. Accordingly, the positions of the docker blocks 304, 314 are controlled by the competing forces of the free ends of the posts 308, 318 abutting the sides of the slots 224, 234 and the force caused by the docker springs 306, 316.

As the press member mounting blocks 204, 214 are actuated to a clamped position, shown in FIG. 2, the actuating force is transferred to the docker blocks 304, 314 by way of the L-shaped brackets 222, 232. Accordingly, the docker blocks 304, 314 (still positioned relative to the L-shaped brackets 222, 232 by the competing forces of slots 224, 234 and docker springs 306, 316) move along the docker shafts 310 toward the film 20.

The movement of the docker blocks 304, 314 along docker shafts 310 is inhibited once the docker blocks 304, 314 come into contact with the wall 220. After the docker blocks 304, 314 contact the wall 220, the press member mounting blocks 204, 214 continue to move, but the actuating force is absorbed by the block springs 306, 316 which compress with the additional movement of the L-shaped brackets 222, 232. As the L-shaped brackets continue to move toward the film 20, after the movement of the docker blocks 304, 314 has been halted by the wall 220, the free ends of posts 308, 318 move within and relative to the slots 224, 234. Accordingly, the docker blocks 304, 314 and other docker mechanisms described below may be accurately moved in directions perpendicular to the film path.

Sets of finger shafts 346, 356, shown in FIG. 2, are secured to and extend from the docker blocks 304, 314 in a direction substantially parallel with the film path of the film 20. Finger mounts 328, 338 are slidably mounted on the finger shafts 346, 356, respectively, such that the finger shafts 346, 356 extend through the finger mounts 328, 338. Finger springs 344, 354 are positioned on the finger shafts 346, 356 and bias the finger mounts 328, 338 away from the docker blocks 304, 314 along finger shafts 346, 356. Free ends of the finger shafts 346, 356 have motion limiters 348, 358 that prevent the finger mounts 328, 338 from being biased past the free ends of the finger shafts 346, 356.

As the docker blocks 304, 314 are actuated in directions perpendicular to the film path, the finger shafts 346, 356 secured thereto move the finger mounts 328, 338 toward and away from the film 20. Fingers 302, 312 for contacting and moving the sliders 24 are secured to the finger mounts 328, 338. Accordingly, the fingers 302, 312 follow the same path of motion as the finger mounts 328, 338. The movement of the fingers 302, 312 and the finger mounts 328, 338 along the finger shafts 346, 356 (i.e., in directions parallel with the film path) is controlled by mechanisms described below.

Shaft arms 322, 332 are secured to free ends of the docking shafts 310. Free ends of the shaft arms 322, 332 include pins (not shown) on which cantilevered arms 324, 334 are rotatably mounted. The plane of rotation of the cantilevered arms 324, 334 is substantially perpendicular to the plane in which the film 20 travels.

Rotatably secured to the cantilevered arms 324, 334 are docker assembly rollers 326, 336, which rotate in a plane substantially parallel with the plane of rotation of the cantilevered arms 324, 334.

The docker assembly rollers 326, 336 serve as cam followers that are actuated by the stationary docker cams 40. Accordingly, as the rotating belt 60 moves the pressing/docking assembly 400 along the belt path, the docker assembly rollers 326, 336 contact the docker cams 40 along the length thereof and are actuated by the profiles of the docker cams 40. In turn, the actuating force moves cantilevered arms 324, 334 in their respective planes of rotation. The profiles of docker cams 40 may be configured in any number of ways to move the cantilevered arms given the speed and other requirements of the manufacturing system.

Figure 7:
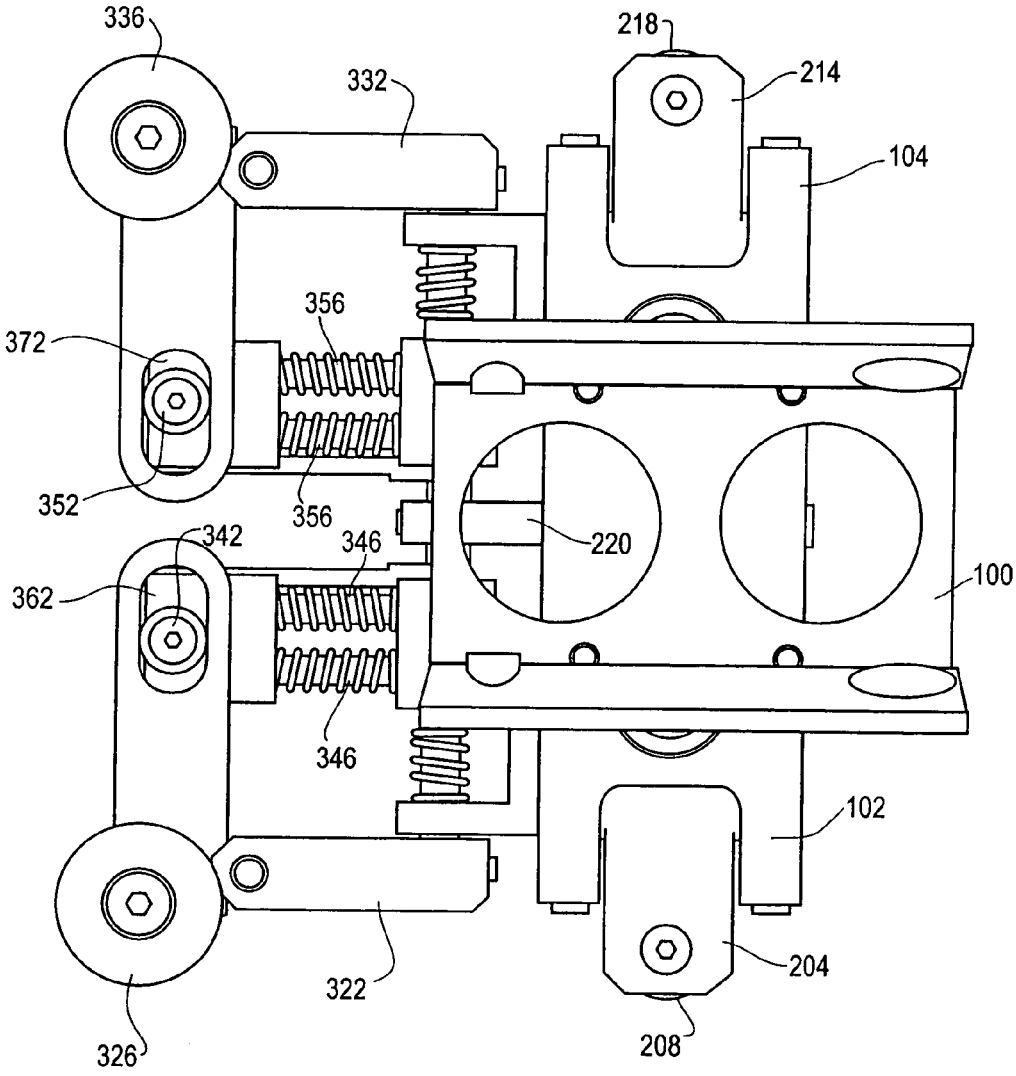
FIG. 7 is rear view of the assembly shown in FIG. 1.

Free ends of the cantilevered arms 324, 334 include arm slots 362, 372 extending therethrough, respectively, which serve as moving cam tracks. Positioned within the arm slots 362, 372 are finger mount cam followers 342, 352, shown in FIG. 7, which are actuated by the movement of the cantilevered arms 324, 334. The finger mount cam followers 342, 352 are secured to the finger mounts 328, 338.

Consequently, as the docker assembly rollers 326, 336 are actuated by the docker cams 40, the cantilevered arms 324, 334 rotate about their axes (i.e., about the pins of the shaft arms 322, 332). In turn, the free ends of the cantilevered arms 324, 334, including the arm slots 362, 372, move in an arcuate path. The movement of the arm slots 362, 372 biases the finger mount cam followers 342, 352 to move the finger mounts 328, 338 along the finger shafts 346, 356 toward the docker blocks 304, 314. Accordingly, the fingers 302, 312 are moved in directions substantially parallel with the path of the film 20 as the docker assembly rollers 326, 336 are actuated by the docker cams 40. This movement pushes the slider 24 along the mating zipper elements 22.

Thus constructed, the pressing/docking assembly 400 being moved along the rotating belt 60 comes into contact with docker cams 40 and press cams 30 while positioned to act on film 20, which is traveling in the film path at the same rate as the pressing/docking assembly 400. As the pressing/docking assembly 400 moves along the cams 30 and 40, the press members 202, 212 clamp a length of the mating zipper elements 22 and fuse them, as shown in FIG. 3. The fused portion defines what will be the ends of the mating zipper elements 22 of two adjacent bags or other such products.

As the pressing members 202, 212 move to the clamped position, the fingers 302, 312 are biased toward the film 20 in a direction substantially parallel with the path of movement of the pressing members 202, 212. However, the abutment of the docker blocks 304, 314 against the wall 220 stops the movement of the fingers 302, 312 prior to the press members 202, 212 reaching their fully clamped position. This prevents the fingers 302, 312 from coming into contact with the film 20. (At this closed position of the fingers 302, 312, the fingers 302, 312 are spaced from the film 20 at a distance in which they may contact the slider 24 mounted thereon when moved toward the slider 24.)

Figure 4:
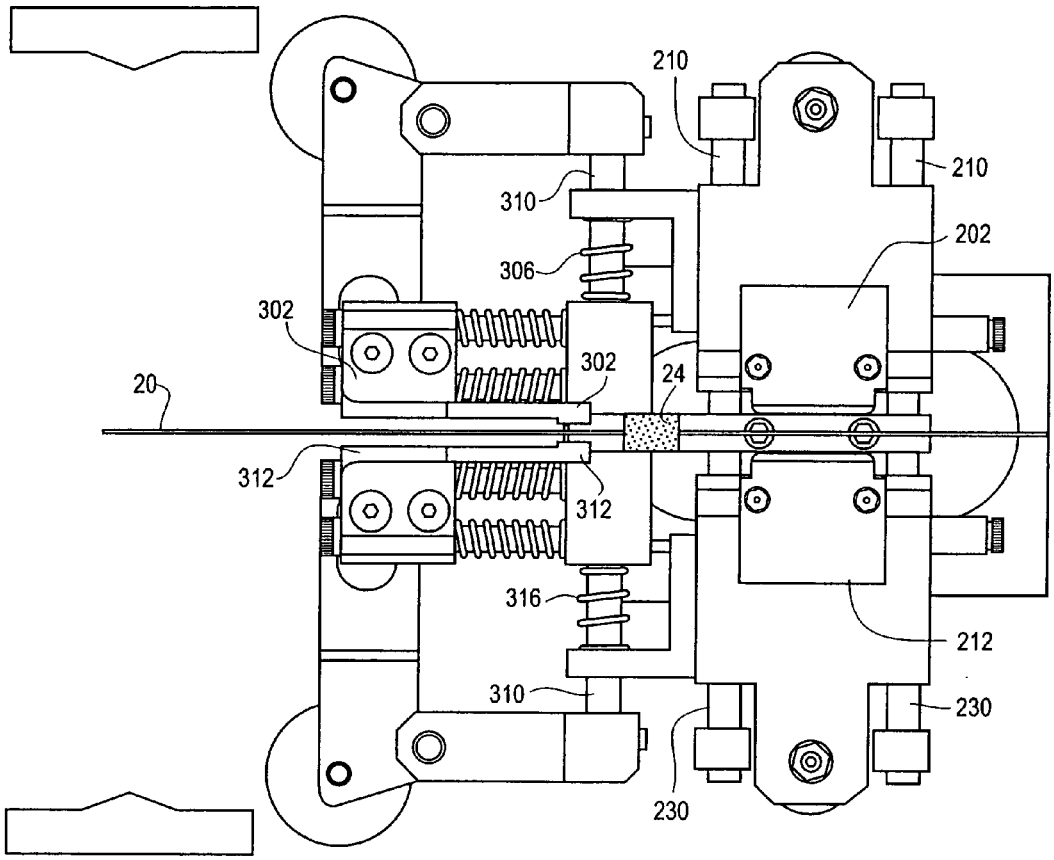
FIG. 4 is a plan view of the assembly shown in FIG. 1 in a third position of operation.

After the fusion of the mating zipper elements 22 is performed, the pressing/docking assembly 400 moves to a point along the press cam 30 that causes the press member 202, 212 to partially open, as shown in FIG. 4. The profile of the press cams 30 at this stage in the path allows the press members 202, 212 to be opened by the biasing force of block biasing springs 206, 216 to a position wide enough that the slider 24 can fit therebetween, but not to a position that the fingers 302, 312 begin to move to the open position (i.e., the edges of the slots 224, 234 of the L-shaped brackets do not come into contact with the posts 308, 318 so as to begin moving docker blocks 304, 314 toward the open position shown in FIG. 2).

While the press members 202, 212 are kept in this partially open position by the press cams 30, the profiles of the docker cams 40, as the pressing/docking assembly 400 travels along the film path, actuate the docker assembly rollers 326, 336. As described in detail above, this causes the fingers 302, 312 to move toward the press members 202, 212, and hence toward the fused length of mating zipper elements 22. As the fingers 302, 312 are moved toward the press members 202, 212, they contact the slider 24. Accordingly, the fingers 302, 312 push the slider 24 along the mating zipper elements 22 in a direction opposite to the movement of the film 20. As shown in FIG. 5, at the fully extended positions of the fingers 302, 312, the slider 24 is moved to a predetermined position along the mating zipper elements 22 relative to the fused portions of the zipper elements, and positioned in between press members 202, 212.

With the placement and profile of the cams 30 and 40, the system is timed such that once the slider 24 is moved to its predetermined position relative to the fused portions of the zipper elements, the pressing/docking assembly 400 reaches a position relative to the cams 30 and 40 such that the block rollers 208, 218 and docker assembly rollers 326, 336 are able to be biased to their fully open positions by the block biasing springs 206, 216 and finger springs 344, 354, respectively. Then, the pressing/docking assembly 400 is moved out of range of the film 20 as it travels along the rotating belt 60 back to the induction heater 50 to be heated for another pass along the film path.

Of course, the mechanisms for operating the fingers 302, 312 and press members 202, 212 may be varied while keeping with the intended scope of the invention. In particular, the pressing/docker assembly 400 may be used in manufacturing systems where the film 20 is indexed to stationary stages. In those cases, mechanisms other than stationary cams 30 and 40 may be used to bias the movable parts of pressing/docker assembly 400. In addition, the designs/arrangements of the arms, shafts, springs, fingers and other such components may be varied while still keeping within the scope of the present invention.

Thus, the embodiment discussed above is representative of embodiments of the present invention and is provided for illustrative purposes only. It is not intended to limit the scope of the invention. Although components, materials, configurations, temperatures, etc., have been shown and described, such are not limiting. Modifications and variations are contemplated within the scope of the present invention, which is intended only to be limited only by the scope of the accompanying claims.

INDUSTRIAL APPLICABILITY

The apparatus and method of the present invention are suited for moving a slider mounted on mating zipper elements during the production of plastic bags or the like including the slider and mating zipper elements. The apparatus and method are particularly useful in fusing a length of the mating zipper elements and positioning the slider with respect to the fused length so as to close the plastic bag or the like.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. An apparatus used in a process of manufacturing a thermoplastic zipper, the apparatus comprising:

a pair of press members mounted on opposing blocks that are configured for placement on opposite sides of a thermoplastic zipper;

a first set of biasing springs that bias the pair of press members away from each other and a thermoplastic zipper disposed therebetween;

a pair of fingers mounted on opposing finger mounts that are configured for placement on opposite sides of a thermoplastic zipper, the pair of fingers configured to push a mounted slider along a thermoplastic zipper;

a second set of biasing springs that bias the pair of fingers away from the pair of press members; and a third set of biasing springs that bias the pair of fingers toward each other and a thermoplastic zipper disposed therebetween;

wherein the pair of press members is configured to clamp a thermoplastic zipper to form an end thereof.

2. The apparatus according to claim 1, wherein the pair of fingers is configured to move toward a thermoplastic zipper placed therebetween so as to be spaced from a thermoplastic zipper at a distance at which a thermoplastic zipper can pass between the pair of fingers but a slider mounted on the thermoplastic zipper cannot pass between the pair of fingers along the zipper path.

3. The apparatus according to claim 2, wherein the pair of fingers is configured to move in a direction substantially parallel along a zipper path and relative to the pair of press members to push a slider along a thermoplastic zipper.

4. The apparatus according to claim 3, wherein the pair of fingers is configured to push a slider mounted on a thermoplastic zipper to a predetermined position along the thermoplastic zipper.

5. The apparatus according to claim 4, wherein the pair of fingers pushes a slider mounted on a thermoplastic zipper along the zipper path in a direction toward the pair of press members.

6. The apparatus according to claim 3, wherein the pair of press members moves from a first fully open position to a second position where the pair of press members clamps and fuses a length of a thermoplastic zipper, and from the second position to a third position where the pair of press members is spaced such that a slider mounted on the thermoplastic zipper may pass therebetween.

7. The apparatus according to claim 6, wherein the pair of fingers pushes a slider mounted on a thermoplastic zipper to a position along the thermoplastic zipper between the pair of press members when the pair of press members is in the third position.

8. The apparatus according to claim 7, wherein the pair of fingers moves away from the zipper path once a slider mounted on a thermoplastic zipper is positioned between the pair of press members.

9. The apparatus according to claim 1, further comprising press member cam followers configured to be actuated by cams in directions toward the zipper path, wherein the press members cam followers bias the pair of press members towards the zipper path.

10. The apparatus according to claim 9, wherein the press member cam followers bias the pair of finger mounts towards the zipper path.

11. The apparatus according to claim 10, further comprising:

first finger cam followers actuated by cams toward the zipper path, the first finger cam followers each comprising a finger cam; and second finger cam followers actuated by the finger cams of the first finger cam followers in a direction substantially parallel with the zipper path, wherein the second finger cam followers are secured to the pair of fingers.

12. The apparatus according to claim 9, further comprising:

a pair of brackets, wherein the press member cam followers bias the pair of fingers through the pair of brackets; and at least one motion limiter that limits the motion of the pair of fingers toward the zipper path before the press member cam followers fully bias the pair of press members to clamp a thermoplastic zipper disposed therebetween.

13. The apparatus of claim 1, wherein the apparatus is heated before engaging a thermoplastic zipper.

* * * * *